US010512331B2

(12) United States Patent
Zhang

(10) Patent No.: US 10,512,331 B2
(45) Date of Patent: Dec. 24, 2019

(54) ERGONOMIC SMART CHAIR AND MOBILITY SYSTEM AND USE THEREOF

(71) Applicant: Junfang Zhang, Wilmington, DE (US)

(72) Inventor: Junfang Zhang, Wilmington, DE (US)

( * ) Notice: Subject to any disclaimer, the term of this patent is extended or adjusted under 35 U.S.C. 154(b) by 0 days.

(21) Appl. No.: 15/997,642

(22) Filed: Jun. 4, 2018

(65) Prior Publication Data

US 2018/0352959 A1 Dec. 13, 2018

Related U.S. Application Data

(60) Provisional application No. 62/517,632, filed on Jun. 9, 2017.

(51) Int. Cl.

| | |
|---|---|
| ***A47C 3/20*** | (2006.01) |
| ***A47C 1/024*** | (2006.01) |
| ***A47C 7/38*** | (2006.01) |
| ***A47C 7/72*** | (2006.01) |
| ***A47C 7/50*** | (2006.01) |
| ***A47C 7/46*** | (2006.01) |
| ***A61G 5/10*** | (2006.01) |
| ***A61G 5/12*** | (2006.01) |
| ***A47C 1/03*** | (2006.01) |
| ***A47C 7/00*** | (2006.01) |
| ***A47C 7/74*** | (2006.01) |
| ***A47C 3/40*** | (2006.01) |
| ***A47C 1/022*** | (2006.01) |
| ***A47C 31/00*** | (2006.01) |

(Continued)

(52) U.S. Cl.

CPC ..... *A47C 1/0242* (2013.01); *A47C 1/022* (2013.01); *A47C 1/03* (2013.01); *A47C 3/20* (2013.01); *A47C 3/40* (2013.01); *A47C 7/006* (2013.01); *A47C 7/38* (2013.01); *A47C 7/46* (2013.01); *A47C 7/506* (2013.01); *A47C 7/624* (2018.08); *A47C 7/72* (2013.01); *A47C 7/723* (2018.08); *A47C 7/725* (2013.01); *A47C 7/727* (2018.08); *A47C 7/748* (2013.01); *A47C 31/008* (2013.01); *A61G 5/006* (2013.01); *A61G 5/1002* (2013.01); *A61G 5/1067* (2013.01); *A61G 5/1094* (2016.11); *A61G 5/121* (2016.11); *A61G 5/125* (2016.11); *A61G 5/127* (2016.11); *A47C 1/036* (2013.01); *A61G 7/0573* (2013.01); *A61G 2203/12* (2013.01); *A61G 2203/14* (2013.01); *A61G 2203/20* (2013.01); *A61G 2203/36* (2013.01)

(58) Field of Classification Search

None

See application file for complete search history.

(56) References Cited

U.S. PATENT DOCUMENTS

| | | | | |
|---|---|---|---|---|
| 4,920,587 A * | 5/1990 | Kerr | ..... | A47K 11/02 4/480 |
| 6,009,570 A * | 1/2000 | Hargest | ..... | A61G 7/002 220/789 |

(Continued)

*Primary Examiner* — K. Wong

(74) *Attorney, Agent, or Firm* — Gann G Xu

(57) ABSTRACT

This is directed to a smart ergonomic chair and mobility system. The system can be used as a working station, a working chair, a mobility device, a personal care device, or a combination thereof. The system is designed to provide ergonomic seating posture for a person who is seated on the chair. The system is also designed to reduce body stress by providing automatic movements of parts of the chair at predefined time points.

11 Claims, 10 Drawing Sheets

(51) Int. Cl.

| | |
|---|---|
| ***A47C 7/62*** | (2006.01) |
| ***A61G 5/00*** | (2006.01) |
| *A47C 1/036* | (2006.01) |
| *A61G 7/057* | (2006.01) |

(56) References Cited

U.S. PATENT DOCUMENTS

| | | | | |
|---|---|---|---|---|
| 6,315,319 | B1 * | 11/2001 | Hanson | A61G 5/006 280/250.1 |
| 6,374,436 | B1 * | 4/2002 | Foster | A61G 7/0015 5/624 |
| 8,783,781 | B1 * | 7/2014 | McClure | A47C 4/54 297/452.41 |
| 8,909,357 | B2 * | 12/2014 | Rawls-Meehan | A47C 20/041 700/17 |
| 9,241,574 | B2 * | 1/2016 | Koch | A47C 31/008 |
| 9,655,458 | B2 * | 5/2017 | Jacobs | A47C 1/029 |
| 9,715,822 | B2 * | 7/2017 | Hille | A47C 20/041 |
| 9,921,726 | B1 * | 3/2018 | Sculley | H04W 4/04 |
| 2017/0150264 | A1 * | 5/2017 | Nelson | A47C 7/72 |

* cited by examiner

ERGONOMIC SMART CHAIR AND MOBILITY SYSTEM AND USE THEREOF

FIELD OF THE DISCLOSURE

This is directed to a smart ergonomic chair and mobility system. The chair system can be used as a working station, a working chair, a mobility device, an artificial intelligent therapy system, an automobile vacation/camping sleep seat, bed, or a combination thereof.

BACKGROUND

Many people spend long hours sitting on a chair doing work or reading. It is common that some discomfort or body damage to a person can develop, such as pain or damage to a person's spine, back, neck, shoulder, wrist, or eyes.

Therefore, it is in need for a better system for a person to be seated while performing other functions such as writing, drawing, reading or watching a digital display.

SUMMARY

The present invention is directed to a chair system comprising: a seating module configured to support a person, said seating module comprises a polarity of movable parts; a seat support module coupled to the seating module; a mobility module functionally coupled to the seating module configured to independently cause defined movements of each of the movable parts based on control signals; and a control module functionally coupled to the mobility module to provide the control signals; wherein the control module is configured to provide the control signals to the mobility module to cause defined movements of one or more of the movable parts at a set of predefined time points when the chair system is in operation.

The present invention is also directed to a computer-controlled chair and mobility system, the system comprises the aforementioned chair system, a computer program; a signal input/output device functionally coupled to the control module; and a plurality of sensors functionally coupled to the seating module, the mobility module, and the control module; wherein the computer program encodes a process comprising the steps of: receiving sensing signals from one or more of the sensors; generating subject data based on the sensing signals; optionally, retrieving user input signal from the input/output device; retrieving a signal schedule from a database functionally coupled to the control module; wherein the signal schedule comprises movement data on the defined movements of the movable parts and the predefined time points; generating control signals based on the sensing signals, the subject data and the signal schedule; and delivering the control signals to the mobility module to cause the defined movements of one or more of the movable parts at the predefined time points.

The present invention is further directed to an App for a digital device. The App comprises a computer program stored in a non-transitory computer usable storage medium of the digital device. The App can be used to control the chair system described herein.

BRIEF DESCRIPTION OF THE FIGURES

FIG. 1A: A perspective side view of the chair system with a wireless controller. FIG. 1B: Another perspective view of the chair system with additional features. FIG. 1C: An example of a configuration of the head rest. FIG. 1D: Examples of the control module.

FIG. 2A: An example of an illumination device, a device holder and a working surface of the working module. FIG. 2B: An example of configurations of a solar energy device positioned as a part of the illumination device. FIG. 2C: An example of a shading device attached to the accessory frame. FIG. 2D: An example of configurations of the device holder with a device cover. FIG. 2E: An example of the working surface with a work surface anchor.

FIG. 3A: An example of configurations of the chair system with a foot rest. FIG. 3B: An example of configurations of a seat bottom and seat back. FIG. 3C: Another example of configurations of a seat back. FIG. 3D: An example of configurations of the accessory frame. FIG. 3E: A foot rest with a foot stopper. FIG. 3F: A foot rest comprising a massage device. FIG. 3G: An example of configurations of arm rests.

FIG. 4A: One example of configurations of the Mobility module of the smart chair system. FIG. 4B: An example of configurations wherein the seat back of the chair system is in a plat position and the accessory frame is in lowered position.

FIG. 5A: An example of configurations with the discharge processing module positioned under the seat bottom. FIG. 5B: An example of the discharge module with an upper plug and a lower plug.

FIG. 6A: An example of a seating posture with the working station. FIG. 6B: An example of a neck device holder. FIG. 6C: An example of a head device holder. FIG. 6D: An example of a virtual reality (VR) viewer.

FIG. 7A: Basic control diagram. FIG. 7B: Control diagram with mobility module.

FIG. 8A: Chair control App interface. FIG. 8B: Mobility control App interface.

DETAILED DESCRIPTION

This disclosure is directed to a chair system. The chair system comprises:

a seating module configured to support a person, the seating module comprising a polarity of movable parts;

a seat support module coupled to the seating module;

a mobility module functionally coupled to the seating module configured to independently cause defined movements of each of the movable parts based on control signals; and a control module functionally coupled to the mobility module to provide the control signals;

wherein the control module is configured to provide the control signals to the mobility module to cause defined movements of one or more of the movable parts at a set of predefined time points when the chair system is in operation.

The seating module can comprise a seat back, a head rest, a seat bottom, a foot rest and a pair of arm rests functionally coupled together forming a chair, wherein the movable parts are selected from the seat back, a part of the seat back, the head rest, a part of the head rest, the seat bottom, a part of the seat bottom, the foot rest, a part of the foot rest, the arm rests, a part of the arm rests, the seat support module, a part of the seat support module, or a combination thereof.

Examples of configurations of the chair system are provided in figures below.

Figure 1A:
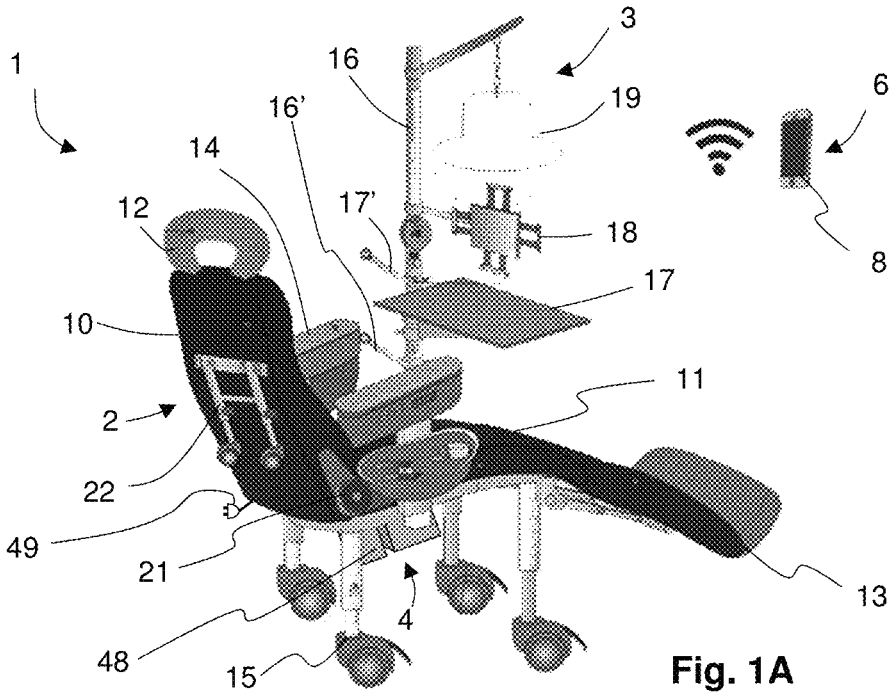
FIG. 1A-FIG. 1D. Representative examples of configurations of the chair system.
Figure 1C:
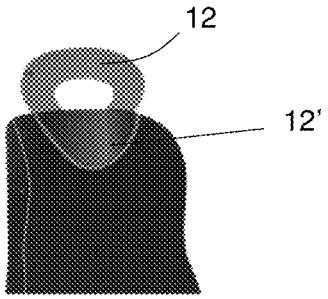
Figure 1B:
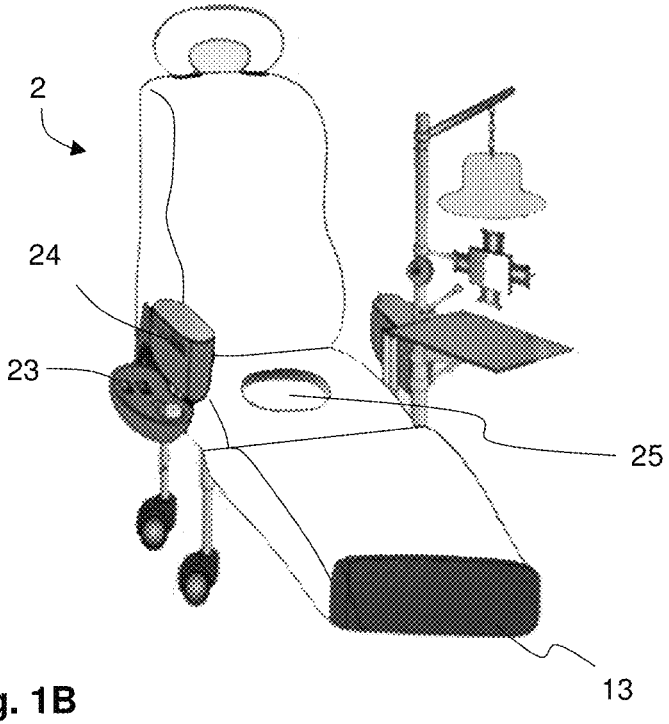

The chair system (1) can comprise a seating module (2), a mobility module (4) and a control module (6) (FIG. 1A).

The seating module can comprise a seat back (10), a seat bottom (11), a head rest (12), a foot rest (13), a pair of arm rests (14) and a seat support module (15) (FIG. 1-FIG. 2). The chair system can further comprise an auxiliary holder (23) for placing items that can be easily reached by the person sitting on the chair and a set of device couplers (24) (FIG. 1B) that can comprise various connectors or adaptors, such as, but not limited to, USB port, HDMI port, audio port, video port, electric power connectors, or any other suitable electrical, electromagnetic or optical connectors or adaptors. The seat back and the seat bottom are joint together at a joint hinge (21) which can comprise a seat back incline adjuster (21') for adjusting seat back to incline. The head rest can be configured to be movable and can be controlled by the control device via the mobility module. The head rest can have a head rest fitting (12') (FIG. 10) configured to fit a person being comfortably seated and fully supported around the head and neck areas.

The seat support module (15) can comprise multiple legs configured to be couple to the seat bottom, the seat back, the foot rest, the arm rests, or a combination thereof. The seat support module can comprise 4 legs in one example, 5 legs in another example, 6 legs in yet another example. In a further example, each of the legs is coupled to a wheel for mobility and a wheel breaking device for stopping wheel movement. In yet a further example, the wheels are coupled to the mobility module and are controlled by the control module and the mobility module for providing movement to the chair system, such as moving forward, backward, and turning left or right. The wheel breaking device can also be controlled by the control module. The seat support module can further comprise a seat back retractable support (22) attached to the seat back for providing support when the seat back in in a flat position (FIG. 1A and FIG. 4B). The seat back retractable support can be attached to the seat back at the back surface that is not in contact with the person seated on the chair, at sides of the seat back, or a combination thereof. The seat support module can also be configured as a single support unit with a plurality of wheels affixed thereto. The seating module can be affixed to the single support unit so the chair system can be moving on the wheels.

The mobility module (4) comprises a plurality of motors and motor controls each coupled independently to one or more of the movable parts of the seating module. The mobility module is functionally coupled to the control module to receive the control signals. The mobility module can cause one or more movable parts to move in a linear fashion, to rotate, to tilt, or to vibrate, based on the control signals. The mobility module can further comprise a battery package (48). The battery package can be configured to provide power to the motors and other electric devices of the chair system described herein. The battery package can be affixed to the underside of the seat bottom, to the seat support module, or other suitable parts of the chair system.

Figure 1D:
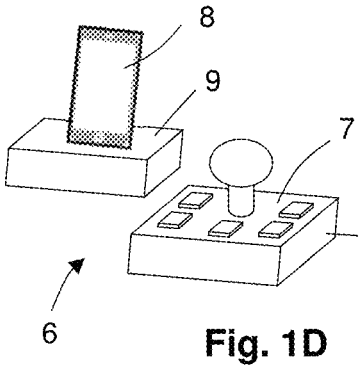

The control module (6) can be selected from a wired control device (7), a wireless control device (8), or a combination thereof (FIG. 1D). When a wired control device is selected, the wired control device can be connected to the mobility module via one of the device couplers (24). The wired control device can also be connected to the mobility module via a dedicated coupler, such as a direct wire connection. When a wireless control device is selected, the wireless control device and the mobility module can be coupled using, such as, but not limited to, WiFi, Bluetooth, infrared, sonic, radio signal, cellular phone signal, satellite signal, or any suitable wireless coupling devices or connections. In one example, the chair system comprises a wired control device. In another example, the chair system comprises a wireless control device. In yet another example, the chair system comprises both the wired and wireless control devices. In a particular example, the wireless control device is selected from a wireless phone, a laptop computing device, an infrared remote control device, or a combination thereof. The wireless control device can comprise a motion sensor, and wherein the wireless control device can be configured to provide one or more of the control signals by predefined motions of the wireless device. In one example, an iPhone can be used as a wireless control device. In another example, an iPhone can be used to control seat back incline by moving the iPhone in a tilting motion. The control module can comprise a charging device (9) for charging and holding the wireless control device (8) (FIG. 1D). The wired control device can comprise one or more control elements, such as a joystick, switches, buttons, dials, or a combination thereof, that are suitable for control one or more functions of the chair system.

The chair system can further comprise a power connector (49) (FIG. 1A) for connecting to a power source, such as a DC or AC power source to provide power to the chair system including the motors and other electric devices described herein.

Figure 2A:
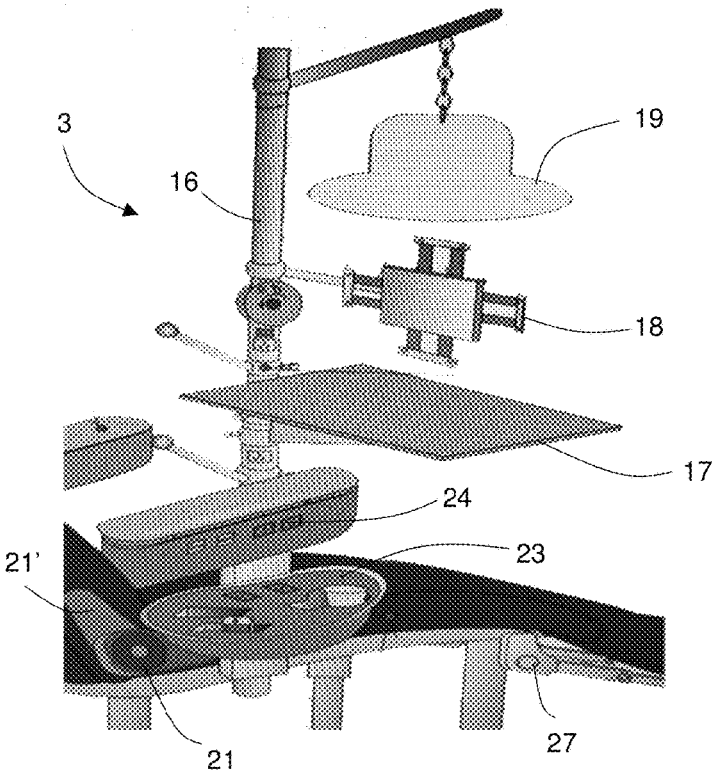
FIG. 2A-FIG. 2E. Examples of configurations of a working module of the chair system.
Figure 2B:
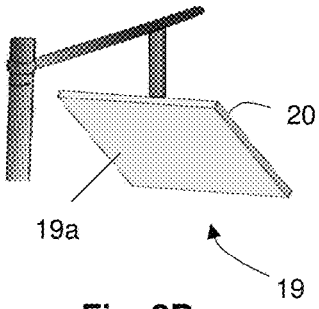
Figure 2C:
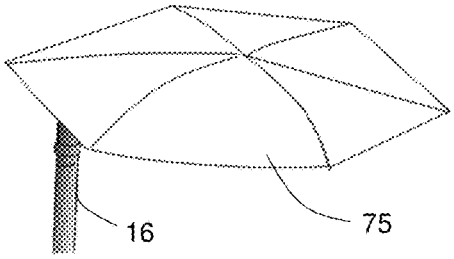
Figure 2D:
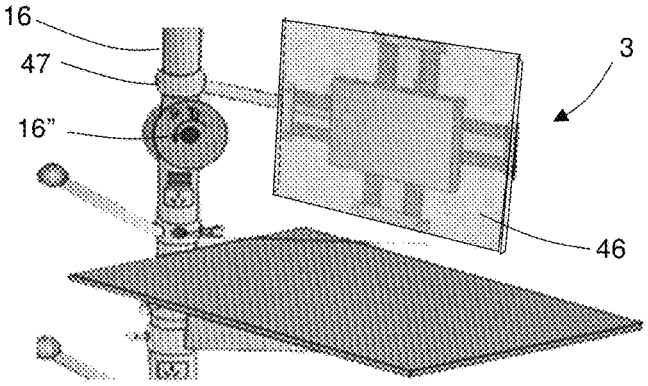
Figure 2E:
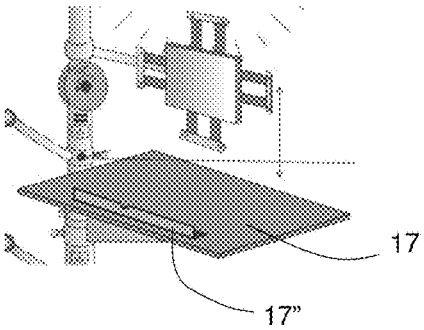
Figure 3A:
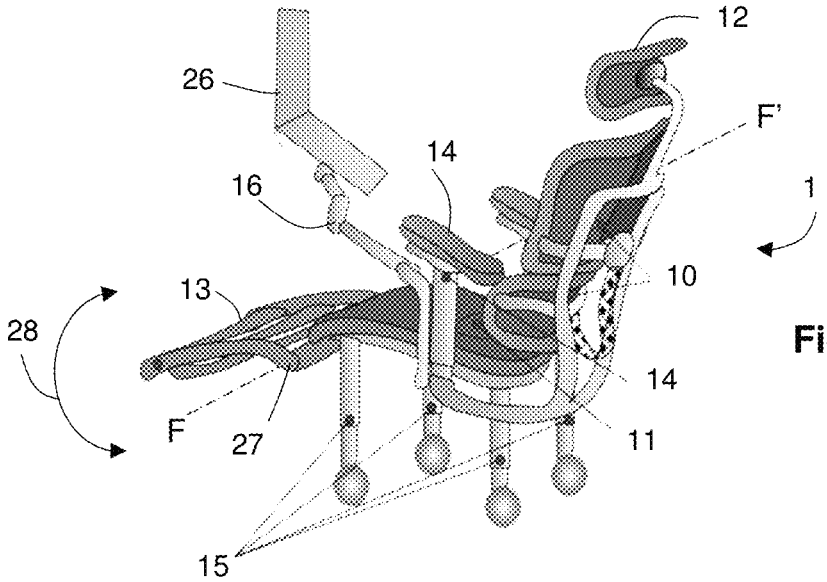
FIG. 3A-FIG. 3G. Further examples of configurations of the chair system.

The chair system can further comprise a working module (3) coupled to the seating module, the seat support module, or a combination thereof, wherein the working module comprises an accessory frame and working accessory functionally coupled together. The working accessory can comprise a working surface (17), a device holder (18), and an optional illumination device (19) (FIG. 1A and FIG. 2A-2E). In one example, the device holder (18) can hold a display device (26) (FIG. 3A).

The working module can further comprise a plurality of adjusters, such as accessory frame adjusters (16' and 16") to adjust the height and rotation of the accessory frame, a working surface adjuster (17') to adjust the position and angle of the working surface (17). The working surface can have a work surface anchor (17") (FIG. 2E) for anchoring or holding working materials, such as a drawing sheet, paper, a tablet, or a laptop. The working module can further comprise an illumination device (19). The working module can comprise a solar energy device (20) for generating electric power under lights, such as under the sun lights. The mobility module of the chair system can comprise an energy storage device. The solar energy device can be functionally coupled to an energy storage device. In one example, the solar energy device can be functionally coupled to the battery package (48) to store the electric power and to provide power to electric devices.

In one example, the solar energy device (20) is configured to be coupled to the illumination device (19). In a particular example, the solar energy device can be positioned on an upper surface of the illumination device (FIG. 2B). A lighting device (19*a*), such as a set of LED lights, can be positioned at a lower surface of the illumination device. The device holder (18) can further comprise an attached device cover (46) to further secure an object positioned on the device holder, especially when the accessory frame is in a flat position, such as illustrated in FIG. 4B. The device holder can be attached to the accessory frame and adjusted vie a device holder adjuster (47) (FIG. 2D).

The working module can be affixed to the seat support module with an accessory frame positioning device (37) that can adjust the accessory frame in accessory frame positioning directions (38) (FIG. 3D) for optimal head distance as described hereafter.

Figure 3B:
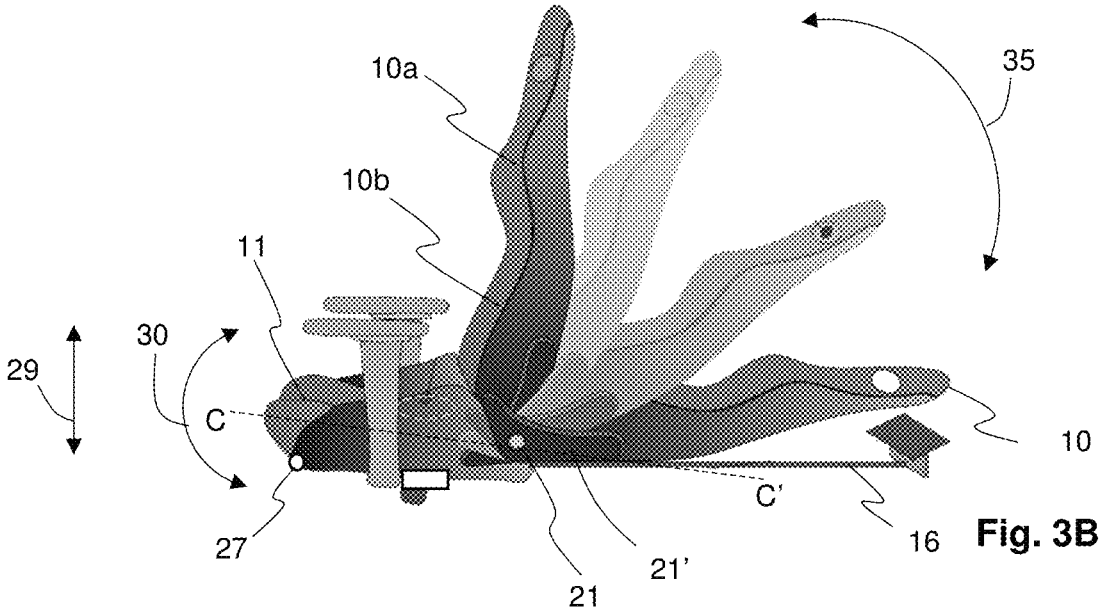
Figure 3C:
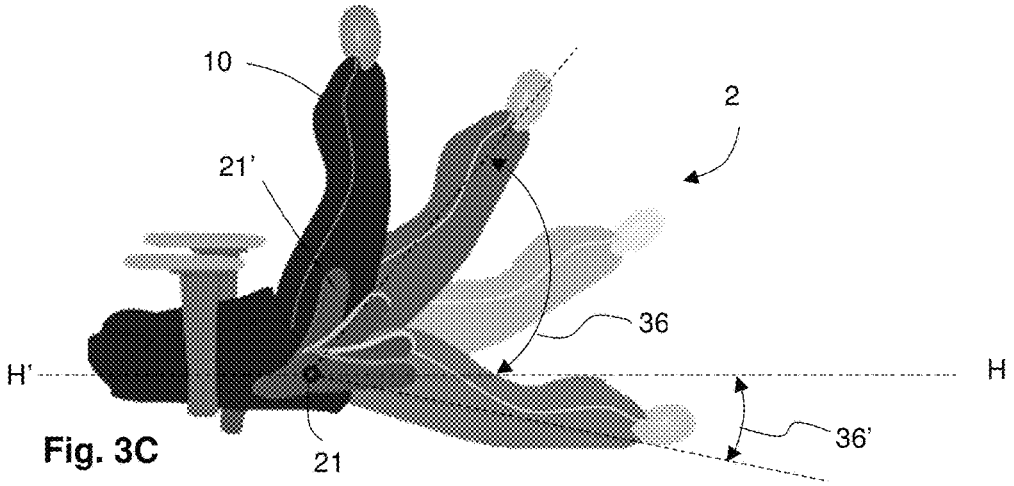
Figure 3D:
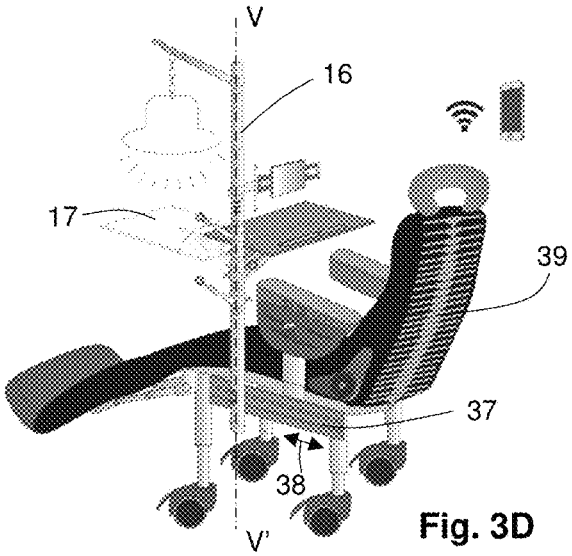

The accessory frame (16) can be configure to have a frame rotational axis (V-V'). The accessory frame, the working surface, the device holder, and the illumination device, can each independently rotate along the frame rotational axis to achieve desired positions of each of the devices (FIG. 3D).

The seat back can be a single piece or composed of multiple pieces positioned for supporting a person seating on the chair system (10) (FIG. 3A).

The foot rest (13) can have one side affixed to a foot rest coupling (27) that is affixed to the seat support module (15) or the seat bottom (11) (FIGS. 3A and 3B), wherein the foot rest coupling has a rotational axis F-F' that is parallel to perspective surface planes of the foot rest and the seat bottom so that the foot rest is configured to rotate along the rotational axis F-F' in foot rest motion directions (28). The rotation of the foot rest is designed to raise and lower legs of a person properly seated on the chair system.

The seat back can have a seat back upper area (10*a*) and a seat back lower area (10*b*). The seat back can comprise multiple seat back devices and movable parts configured in the upper area, the lower area or a combination thereof. Each of the multiple devices and movable parts can be operated independently and controlled by the control module. The seat back devices and movable parts for the upper area and the lower area are independently selected from a thermal device for producing heat, a vibration device, a massage device, a sonication device for producing sonic waves, a magnetic device for producing magnetic fields, a light emitting device for producing lights at a specific range of visible or invisible light wavelengths, or a combination thereof. It is understood that when a light emitting device is selected, the upper area or the lower is configured to have light permeable materials. A set of sensors can be placed and coupled to the seat back devices and movable parts to monitor the parts and provide feedback signals as described hereafter. In one example, a light sensor can be configured to enable light emission only when a person is properly seated on the chair system.

The seat back can have a sectional support. In one example, the sectional support comprises multiple T-shaped ribs coupled together forming a T-sectional back support (39) (FIG. 3D). One advantage of the T-sectional back support is that it can provide firm yet flexible support.

The seat bottom and the seat back can be affixed together at the joint hinge (21) that defines a seat back and seat bottom rotational axis. A seat back incline adjuster (21') can be configured around the joint hinge in seat back motion directions (35) for adjusting seat back to incline and to lock the seat back in a desired position (FIG. 3B). The seat back (10) and the seat bottom (11) can independently rotate to a predefined limit along the seat back and seat bottom rotational axis defined by the joint hinge (21) which is parallel to perspective surface planes of the seat back and the seat bottom. The seat bottom is configured to move in seat bottom up-and-down motion directions (29) and rotate along the joint hinge (21) in seat bottom tilting motion directions (30) (FIG. 3B). The seat back can be adjusted to have a seat back angle (36) in a range of from 0° to 110°, wherein the seat back angle (36) is an angle between the perspective plane of the seat back surface and the horizontal perspective plane H-H' defined by the joint hinge (21) (FIG. 3C). The seat back can also be positioned down-ward relative to the horizontal perspective plane H-H' having a seat back down-ward angle (36') defined by the perspective plane of the seat back surface and the horizontal perspective plane H-H' in a range of from 0° to −45°. The seat back angle (36) can be in a range of from 0° to 110° in one example, 0° to 90° in another example, and 0° to 80° in yet another example. The seat back down-ward angle (36') can be in a range of from 0° to −45° in one example, 0° to −30° in another example, and 0° to −20° in yet another example.

The seat bottom can also be configured to comprise seat bottom devices and movable parts selected from a thermal device for producing heat, a vibration device, a massage device, a sonication device for producing sonic waves, a magnetic device for producing magnetic fields, a light emitting device for producing lights at a specific range of visible or invisible light wavelengths, or a combination thereof. The seat bottom devices and movable parts can be operated independently and controlled by the control module. Sensors can also be placed to monitor and to provide feedback as described herein.

Figure 3E:
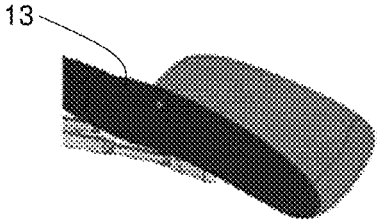
Figure 3F:
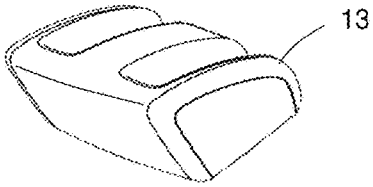

The foot rest can also be configured to comprise foot rest devices and movable parts selected from a thermal device for producing heat, a vibration device, a massage device, a sonication device for producing sonic waves, a magnetic device for producing magnetic fields, a light emitting device for producing lights at a specific range of visible or invisible light wavelengths, or a combination thereof. The foot rest devices and movable parts can be operated independently and controlled by the control module. Sensors can also be placed to monitor and to provide feedback as described herein. Examples of the foot rest are schematically shown in FIG. 3E with a foot stopper and 3F with a massage device.

The head rest can also be configured to comprise head rest devices and movable parts selected from a thermal device for producing heat, a vibration device, a massage device, a sonication device for producing sonic waves, a magnetic device for producing magnetic fields, a light emitting device for producing lights at a specific range of visible or invisible light wavelengths, or a combination thereof. The head rest devices and movable parts can be operated independently and controlled by the control module. Sensors can also be placed to monitor and to provide feedback as described herein.

Figure 3G:
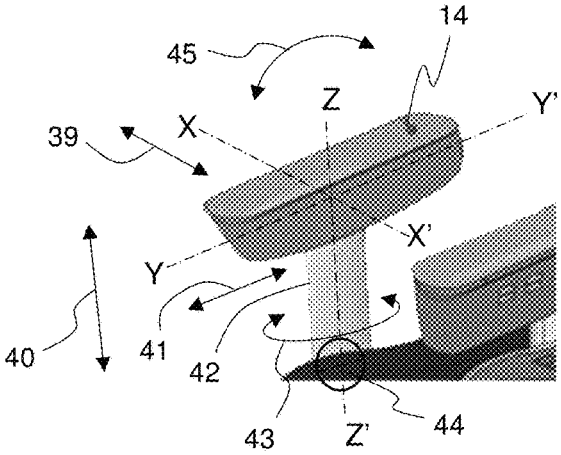

Each of the arm rests (14) can have 3-dimensional movements described hereafter. The arm rest can have arm rest vertical motions in the vertical directions (40) defined by a vertical axis Z-Z', arm rest horizontal motions in horizontal directions Y-Y' (41) and X-X' (39). The arm rest can also be configured to rotate along the arm rest post (42) that can be co-axially aligned with the vertical axis Z-Z' (43) of the arm rest post (42). The arm rest can also have a tilting motion (45) along an arm rest post anchoring hinge (44) (FIG. 3G). Each of the arm rests can have 3-dimensional movements independently and can be controlled by the control module.

Figure 4A:
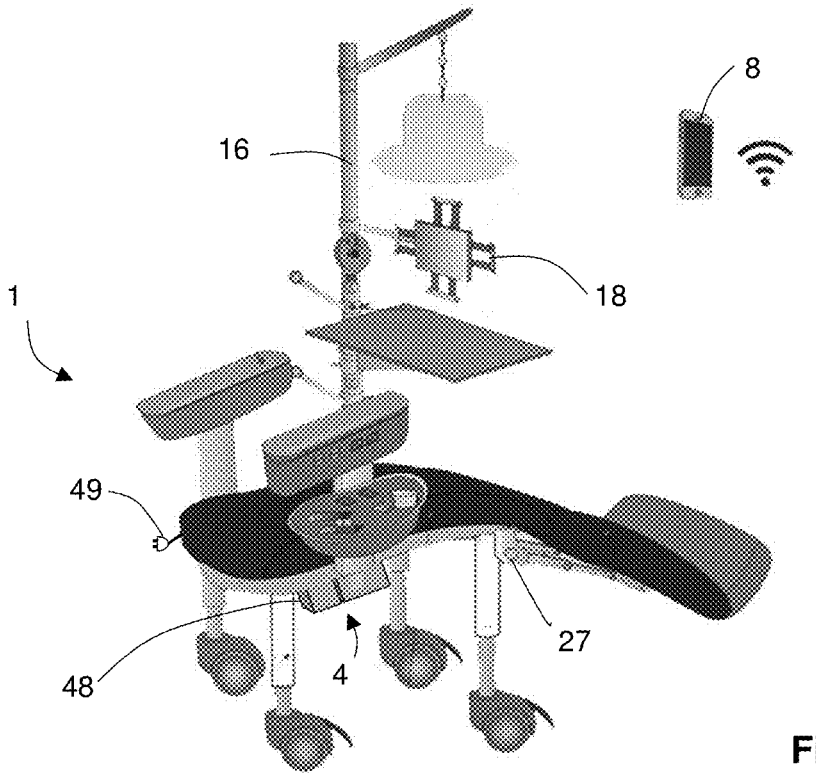
FIG. 4A-FIG. 4B. Further examples of configurations of the chair system.
Figure 4B:
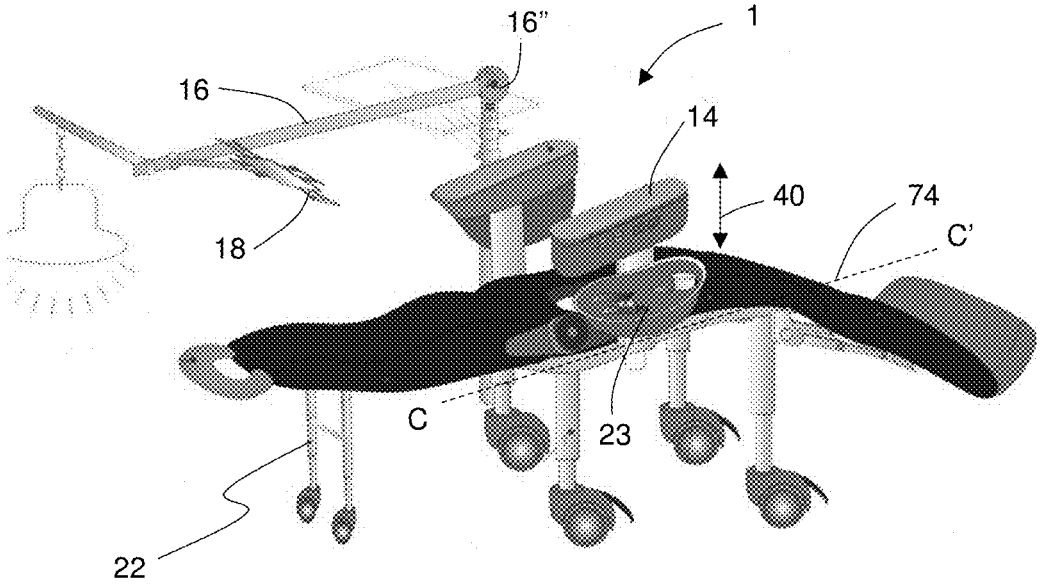

In one example of configurations of the chair system, the seat back can be removed (FIG. 4A). In another example, the seat back can be in a flat position (FIG. 4B). The working module can also be configured accordingly (FIG. 4B). One or both of the arm rests (14) can be removed or moved down in the vertical direction (40) so the arm rest can be placed at or below seat bottom surface plane C-C' (74). The accessory frame can also be removed or placed below the seat bottom surface plane. These configurations can be suitable for transporting a person onto the chair from other places, such as from a bed, an ambulance, a stretcher, or a wheel chair, and can be configured to be adjusted automatically using the control device or manually by an operator.

Figure 5A:
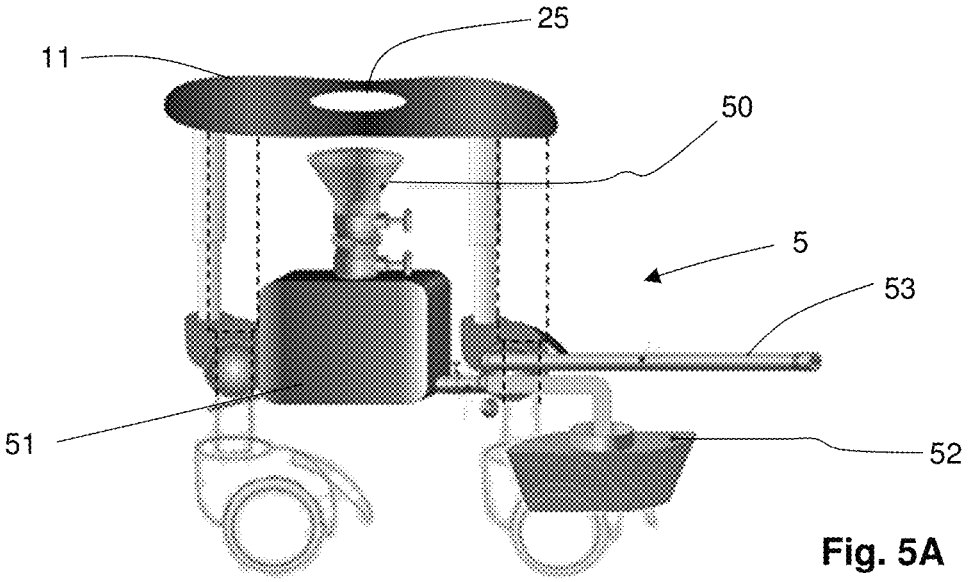
FIG. 5A-FIG. 5B. Examples of configurations of a discharge processing module.
Figure 5B:
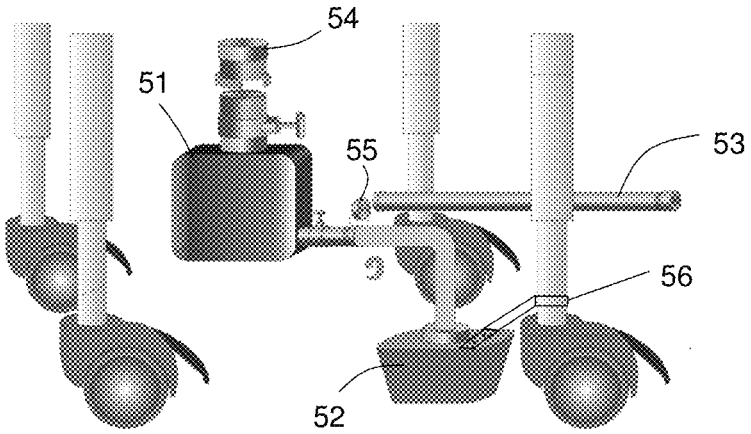

The chair system can further comprise a discharge processing module (5) (FIG. 5A) functionally coupled to the seating module, the seat support module, or a combination thereof, to receive, process and store discharged or waste materials.

The discharge processing module comprises a discharge collection adaptor (50) that can be coupled to or place under a seat bottom opening (25) to collect discharged materials, a discharge collector (51) to collect or process the discharged materials, a discharge storage (52), and a storage anchoring device (56) to affix the discharge storage to the seat support module. The discharge collection adaptor (50), the discharge collector (51) and the discharge storage (52) are functionally connected with pipes or tubes to allow movements of collected discharged materials. The discharge collector (51) can comprise a vacuum device to provide suction to facilitate the collection of the discharged materials. The discharge module can further comprise a discharge drain coupler (53) to drain the discharged materials to a drainage system. The discharge drain coupler (53) can be used to replace the discharge storage (52) when the chair system is used in a fixed location, such as at a hospital, a hospice, or special care unit. The discharge module can further comprise an upper plug (54) and a lower plug (55) to seal corresponding openings when removing the discharge module from the chair system.

In a further embodiment of the chair system, the control module is further configured to provide a warning signal based on a predefined schedule. The working module can further comprise a warning device functionally coupled to the control module to provide a predefined warning based on the warning signal. The warning device can be positioned at the working surface, the device holder, the accessory frame, or any other suitable places of the chair system. The warning device can be configured to provide visual, audial, or movement such as vibration signals to warn the person about the need to pulse the work to get some exercise or moving around to reduce body posture stress or eye stress.

The chair system can further comprise a plurality of sensors functionally coupled to the seating module, the supporting module and the control module. The chair system can comprise a head rest sensor placed in the head rest to sense the position of the head rest and pressure and pattern received by the head rest; an arm rest sensor placed in each of the arm rests to sense the position of the arm rest and pressure and pattern received by the arm rest, a lighting sensor to sense lighting level around the chair system or a specific location of the chair system, such as the working surface; a seat back sensor placed at a predetermined location of the seat back to sense the position of the seat back and pressure and pattern received by the seat back; a seat bottom sensor placed at a predetermined location of the seat bottom to sense the position of the seat bottom and pressure and pattern received by the seat bottom; a foot rest sensor placed at a predetermined location of the foot rest to sense the position of the foot rest and pressure and pattern received by the foot rest; and a mobility sensor to sense movement of the chair system. The mobility sensor can also comprise a global positioning system (GPS), a sonic distance sensor, a laser radar device, a radio-wave distance radar, or a combination thereof, that can determine the position of the chair system in relation to a location map or predefined location markers. In one example, a sonic distance sensor can determine the distance of the chair and walls of a room or a distance away from the edge of stairs. Each of the sensors can have wired or wireless communications with the control module to transmit sensing signals and receiving input signals from the control module. The sensors can provide sensing signals to produce subject data and to determine whether a person is seated on the chair and whether the person is seated properly. The chair system can comprise a distance sensor for determining a desired distance, such as a distance between the face of the person seated on the chair to a display screen placed on the device holder. The distance sensor can be coupled to the control device so the chair can automatically adjust the seat back, seat bottom, and device holder to ensure a proper posture to help reducing potential impact to the person's spine and muscle.

Figure 6A:
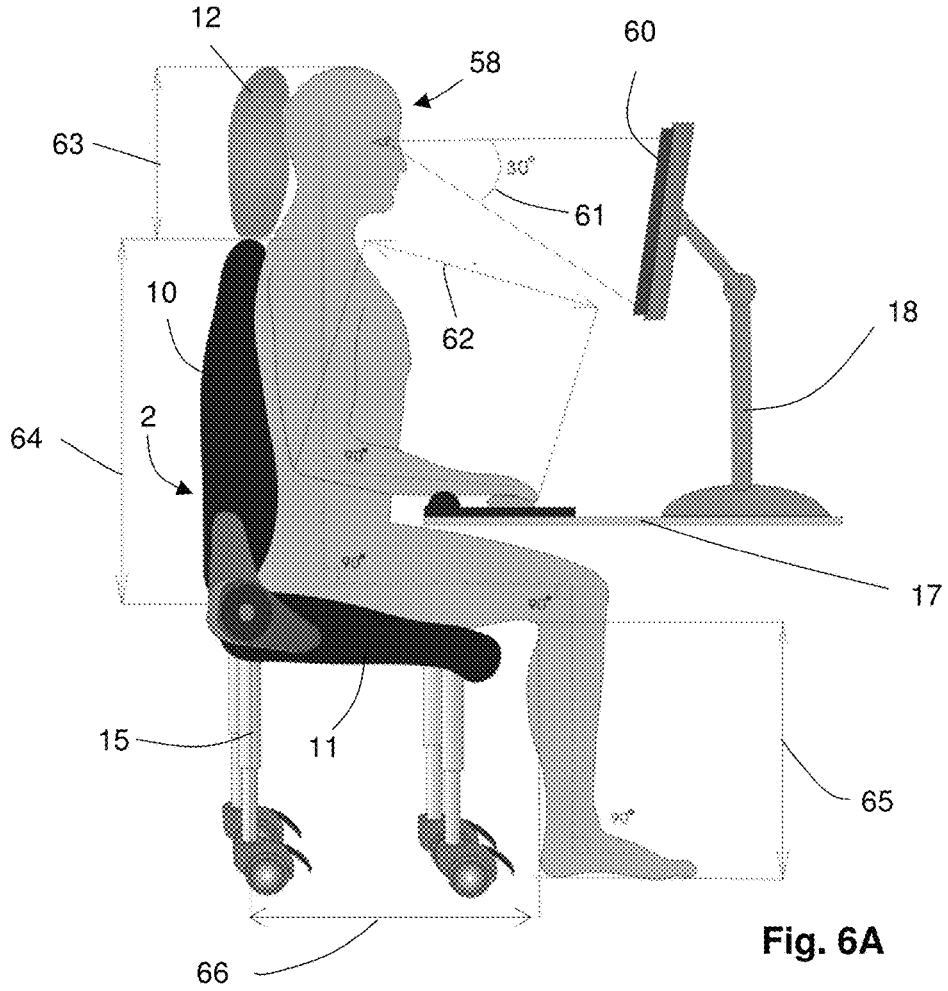
FIG. 6A-FIG. 6D. A representative sketch of reading/working posture with the chair system.

The chair system can be used as a working station. A person can be seated on the seating module (2) reading a viewing object (60) and typing or writing on the working surface (17) (FIG. 6A). The chair system can be adjusted such as by adjusting head rest height (63), seat back height (64), seat back angle (36), seat bottom position and angle, arm rest position and angle, or a combination thereof, to provide optimized view field angle (61), hand distance (62), knee height (65) and foot distance (66) that may help to reduce body stress and the possibility of damage.

Figure 6B:
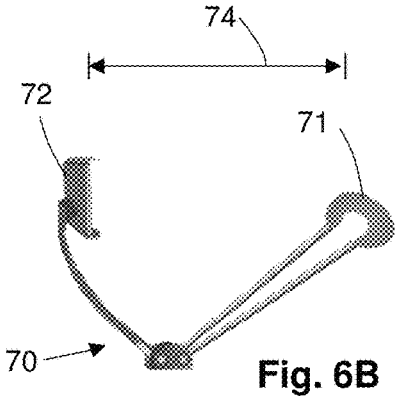
Figure 6C:
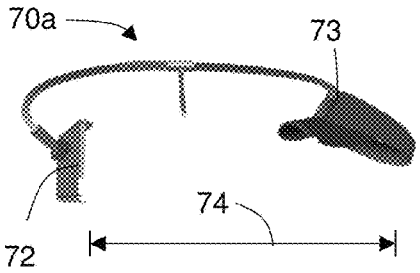
Figure 6D:
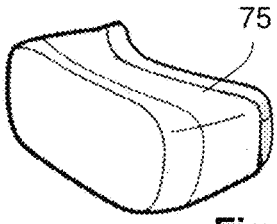

The chair system can further comprise additional devices, accessories, or a combination thereof. In one example, a neck device holder (70) (FIG. 6B) can have a neck coupler (71) and a device adaptor (72) that can be used to attach a display device, such as a cell phone, a tablet, an iPad, an electronic book reader, a projection screen, or any digital or optical devices that can display data, image or other information. The neck device holder can be placed around a person's neck for the person to view information displayed on the display device. In another example, a head device holder (70*a*) can have a head coupler (73) and a device adaptor (72) that can be used to attach any of the aforementioned display devices. The head device holder can be worn on a person's head for the person to view information displayed on the display device (FIG. 6C). A reading distance (74) between the device adaptor (72) and the neck coupler (71) or the head coupler (73) can be in a range of from 14 to 30 inches. The chair system can further comprise a virtual reality (VR) viewer (75) (FIG. 6D) that is functionally coupled to a VR signal source device. The VR viewer can be worn by a person seated on the chair in any of the aforementioned seating positions, such as up-right seating, lay-down with face up, or lay-down with face down. In an example, an iPhone is used as the control device and also a VR signal source device. The chair system can further comprise a camera, a speaker, a microphone, or a combination thereof. These additional devices can be affixed to any of the device holders or adaptors mentioned herein. These devices can be used by the person seated on the chair to communicate with others. In one example, a patient seated on the chair can communicate with friends, family members or health care professionals in a distant location via audio or video conversations. In another example, a care provider can monitor the person seated on the chair via video monitoring. The chair system can further have a fan attached to the accessory frame or other device holders or adaptors for providing air circulation around the chair or the person seated on the chair, a shading device (75) (FIG. 2C) such as a retractable cover or an umbrella attached to the accessory frame or other parts of the seat system to provide protection to the person seated on the chair.

The chair system can further comprise at least a treatment device for treating a body condition of a person seated on the chair, wherein the treatment device is selected from an electronic treatment device, a light treatment device, an electron-magnetic treatment device, a thermal treatment devices, a mechanical treatment device, or a combination thereof. The treatment device can be configured to be controlled by the control module. The treatment device can also be coupled to the chair system via the device couplers (24), the accessory frame (16), the device holder (18), the device adaptor (72), or a combination thereof. In one example, a LED lighting device is attached to the device adaptor (72) so the LED lighting device can be used to emit light with predetermined range of wavelengths for treating skin conditions of a person seated on the chair. In another example, an infrared emitting device can be attached to the device adaptor to deliver infrared energy to a person seated on the chair. In yet another example, a thermal belt can be placed on the seat back to treat back pain of a person seated on the chair, wherein the thermal belt receives power by coupling with the device coupler (24) or directly connecting to a power source.

Figure 7A:
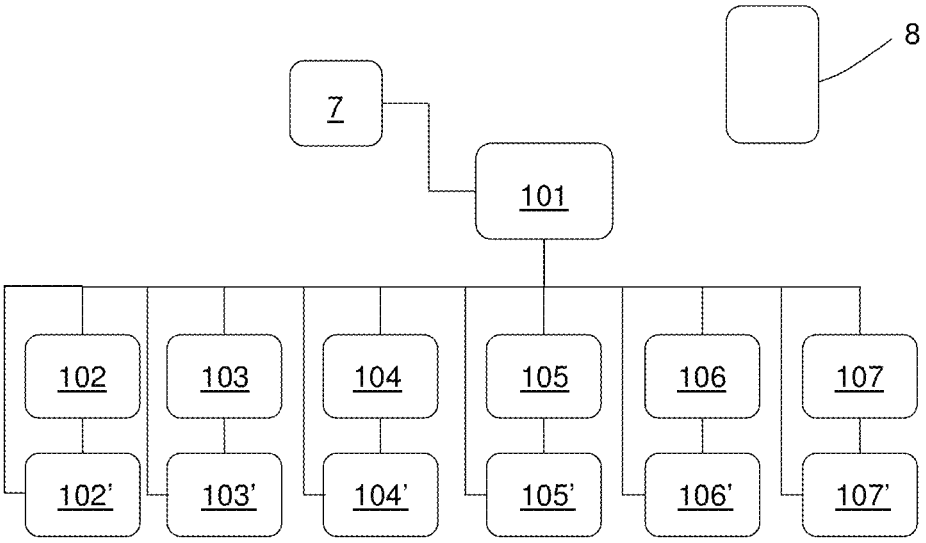
FIG. 7A-FIG. 7B. Diagrams of representative examples of controls.
Figure 7B:
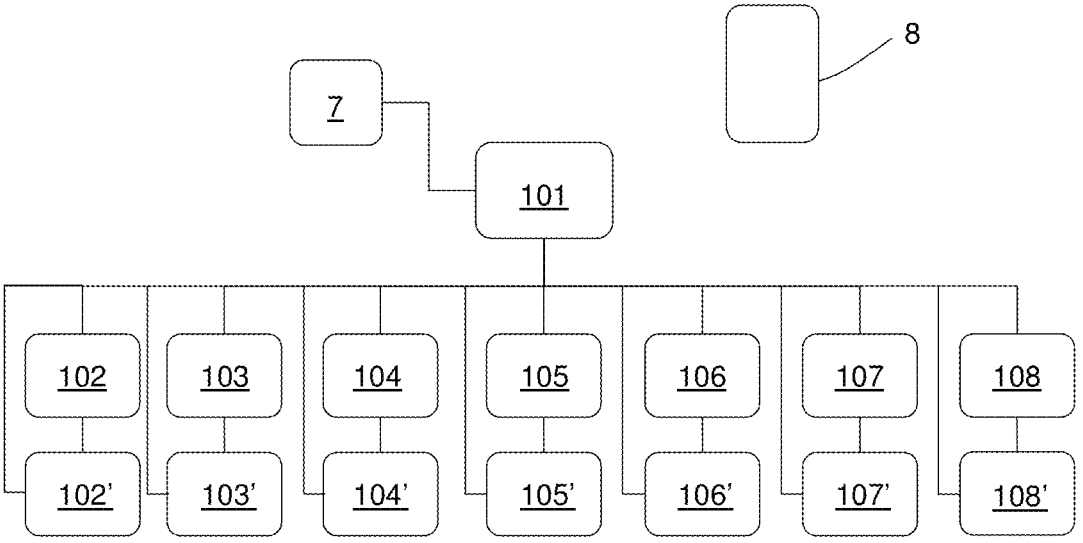

Representative control diagrams are shown FIG. 7. In brief, a main controller (101) is functionally coupled, via aforementioned wired or wireless connections, to a head rest controller (102) and a head rest sensor unit (102'); an arm rest controller (103) and an arm rest sensor unit (103'); a lighting controller (104) and a lighting sensor unit (104'); a seat back controller (105) and a seat back sensor unit (105'); a seat bottom controller (106) and seat bottom sensor unit (106'); and a foot rest controller (107) and a foot rest sensor unit (107') (FIG. 7A). The main controller can further be coupled, via aforementioned wired or wireless connections, to a mobility controller (108) and a mobility sensor unit (108') (FIG. 7B). Each of the sensor units can have one or more functionally coupled sensors. Additional suitable controllers and sensors or sensor units can be incorporated when needed. The main controller (101) can be connected to a wired control device (7), a wireless control device (8), or a combination thereof. Each of the aforementioned controllers can control corresponding movable parts to cause desired movements of the movable parts. Each of the sensors can provide sensing signals for monitoring each of the movable parts and its movement.

This invention is also directed to a computer-controlled chair and mobility system, the system comprises:

a chair system comprising:

a seating module configured to support a person, said seating module comprises a polarity of movable parts;

a seat support module coupled to the seating module;

a mobility module functionally coupled to the seating module configured to independently cause defined movements of each of the movable parts based on control signals; and a control module functionally coupled to the mobility module to provide the control signals;

wherein the control module is configured to provide the control signals to the mobility module to cause defined movements of one or more of the movable parts at a set of predefined time points when the chair system is in operation;

a computer program stored in a non-transitory computer usable storage medium functionally coupled to the control module;

a signal input/output device functionally coupled to the control module; and a plurality of sensors functionally coupled to the seating module, the mobility module, and the control module;

wherein the computer program encodes a computing process comprising the steps of:

receiving sensing signals from one or more of the sensors;

generating subject data based on the sensing signals;

optionally, receiving a user input signal from the input/output device;

retrieving a signal schedule from a schedule database functionally coupled to the control module based on the sensing signals, the subject data and optionally the user input signal; wherein the signal schedule comprises movement data on the defined movements of the movable parts and the predefined time points;

generating control signals based on the sensing signals, the subject data and the signal schedule; and delivering the control signals to the mobility module to cause the defined movements of one or more of the movable parts at the predefined time points.

The control module can be selected from a wired control device, a wireless control device, or a combination thereof. Any of aforementioned wired or wireless control devices can be suitable.

The wireless control device comprises a motion sensor, and wherein the wireless control device is configured to provide one or more of the control signals by predefined motions of the wireless device.

Figure 8A:
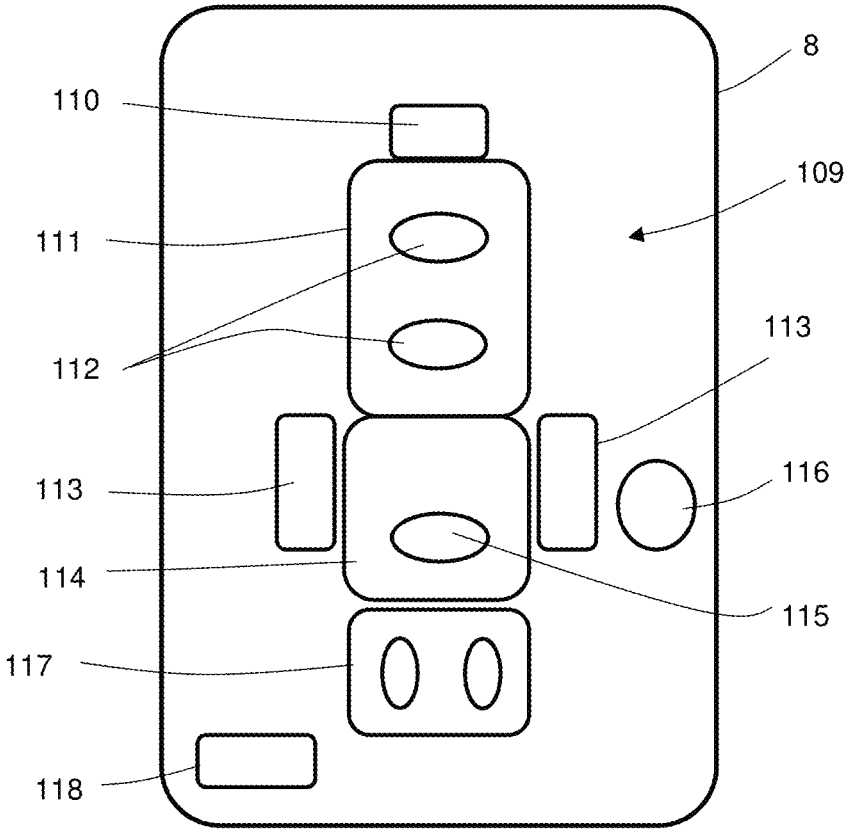
FIG. 8A-FIG. 8B. Representative examples of control App user interface.
Figure 8B:
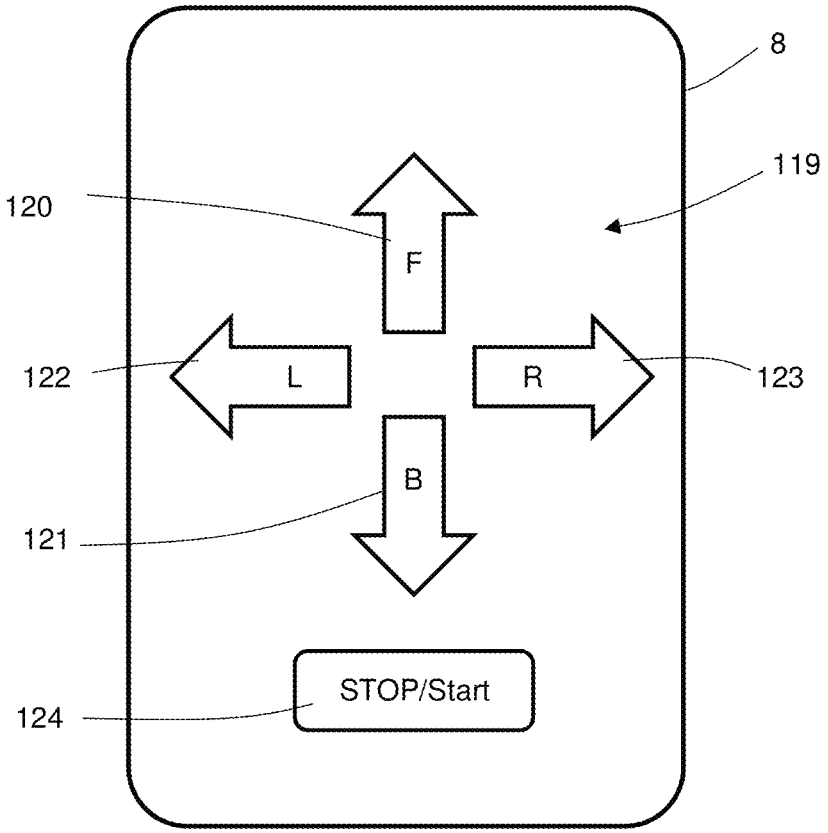

The computer program can be stored in a non-transitory computer usable storage medium functionally coupled to the control module, such as a memory device of a wireless, such as an iPhone, a laptop computer, an iPad or a note pad device. The computer program can be packaged as an App that can be installed and operated in a digital device, such as a wireless phone, an iPhone, an iPad, a notebook computer, or any suitable wired or wireless digital devices. The App can have a graphic user interface. Schematic examples of an App user interface for a control device with a touch screen is shown in FIG. 8. A non-touch screen device can also be suitable.

In brief, the App can be installed on a wireless device or any other programmable device with a touch screen. On the touch screen, a schematic diagram of the chair system (109) can be displayed that comprises touchable areas for a touch controller for head rest (110), a touch controller for seat back (111), one or more touch controllers for the upper and lower areas of seat back (112), a pair of touch controllers for arm rests (113), a touch controller for seat bottom (114), a touch controller for a seat bottom area (115), a touch controller for lighting (116), a touch controller for foot rest (117), and a touch controller for mobility module (118) (FIG. 8A). In one example, the touch controller for mobility module is displayed as an icon that can be expanded into a full-size controller upon touching. Each of the touch controllers can control corresponding movable parts or lighting devices to move in a suitable movement directions, turn on or off the corresponding devices, display current position of the movable parts, or a combination thereof.

In an example, the touch controller for mobility module (118) is expanded into a full mobility control display (119) that comprises a forward motion control icon (120), a backward motion control icon (121), a left motion control icon (122), a right motion control icon (123), and a stop/start control icon (124). The stop/start control icon can be displayed a green icon for start and s red icon for stop. The mobility control can also be performed by moving the controller when the controller comprises a motion sensor. In one example, lowering the wireless device forward can cause the chair to move forward, while lowering the wireless device to the left can cause the chair to turn left, and a rapid lowering of the wireless device can cause the chair to stop. Other configurations of the combinations of device motion and movement of the chair can also be suitable.

The computing process can further comprise the steps of:

generating weight distribution data based on the subject data;

producing a weight distribution map data based on the weight distribution data; and displaying the weight distribution map on a display device based on the weight distribution map data.

The weight distribution map can be displayed on the touch screen of the wireless control device, a wired or wireless TV monitor, a laptop computer screen, or a VR viewer, that are configured to receive the weight distribution map data.

Figure 9:
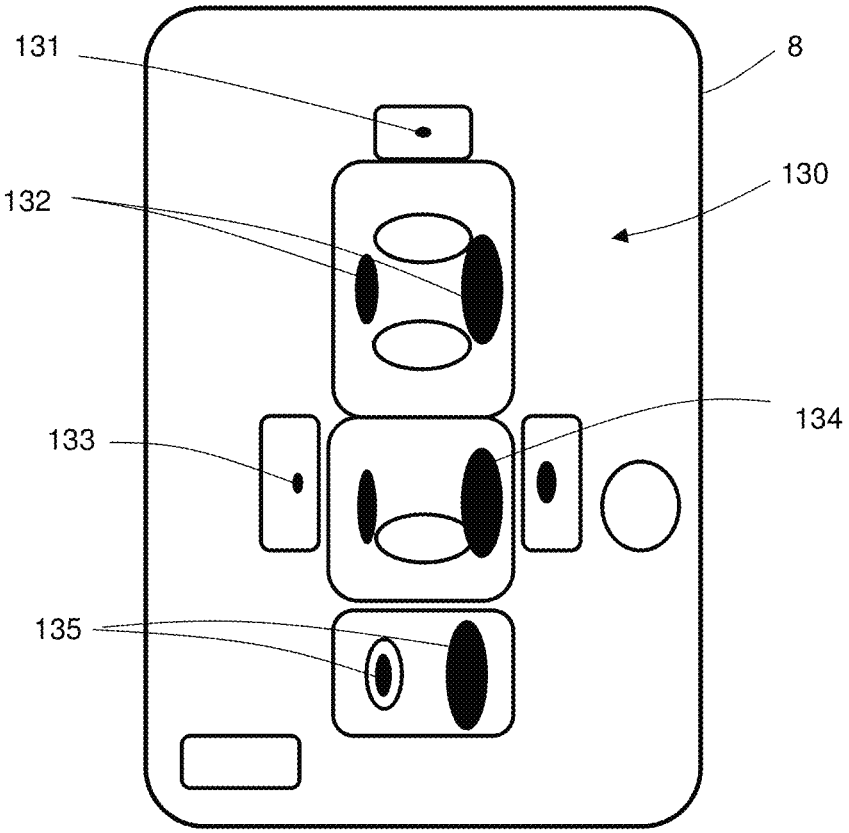
FIG. 9. A Schematic presentation of examples of the weigh distribution map.

In one example, the weight distribution map can be displayed as areas of varying sizes or shades of colors that overlay on the control icons on the touch screen (130) (FIG. 9) wherein an area of a larger size or darker in color represents more weight received in that location of the chair. Beside sizes and shades of color, any other symbols or graphic presentations can also be suitable for displaying the weight distribution map. In an example, a weight distribution map can display weight distribution in various areas of the chair including those in the head rest area (131), seat back areas (132), arm rest areas (133), seat bottom areas (134) and foot rest areas (135) (FIG. 9). Different sizes in a same chair area may signal uneven distribution of weight that could be caused by an improper seating position. The App may provide a warning signal or a reminder for the person to seat properly.

The App can be configured to perform a computing process comprising the steps of:

(1) receiving sensing signals from one or more of the sensors, such as the sensors located in the seat bottom to determine whether a person is seated on the chair;

(2) communicating with sensors located in the seat back, the seat bottom, the head rest, the arm rest, and the foot rest to receive sensing signals comprise pressure and pattern for each of the sensors;

(3) generating subject data based on the sensing signals, the subject data can comprise the weight of the person, seating posture of the person;

(4) generating weight distribution data based on the subject data, producing a weight distribution map data based on the weight distribution data, and displaying the weight distribution map on a display device based on the weight distribution map data;

(5) producing a warning signal if improper seating position is determined based on the weight distribution data;

(6) optionally, receiving user input signals from the input/output device, such as desired time intervals, directions and/or patterns for seat back movements, seat bottom movements, arm rest movements, foot rest movements, or a combination thereof, or selecting from a pre-set menu for desired movements or movements combinations;

(7) if a selection is made from the pre-set menu, retrieving a signal schedule from a database functionally coupled to the control module; wherein the signal schedule comprises pre-set movement data on the defined movements of the movable parts and the predefined time points;

(8) generating control signals based on the sensing signals, the subject data and the signal schedule; and (9) delivering the control signals to the mobility module to cause the defined movements of one or more of the movable parts based on the selection or based on the signal schedule.

The control signals can be generated based on the sensing signals, the subject data and the signal schedule. For example, the control signal for moving the seat back can be dependent upon the weight of the person seated on the chair that is sensed by the sensors and included in the sensing signals. In another example, control signals for moving each of the arm rests can be different based on sensing signals. In yet another example, the control signals for moving each of the arm rests are different based in the user input signals indicating different levels of desired movements for each of the arms.

A user can enter a condition, such as neck pain around vertebrae C1-C7, into a wireless control device via an App. The App automatically connects to the database to search and retrieve treatment schedule suitable for treating or alleviating pain. A number of movement and exercise choices can be displayed on the screen of the control device. The use can select one or more of the choices on the control device and initiate the treatment. The control device generates control signals based on the user selection and the treatment schedule causing a number movable parts to move to stimulate or move certain parts of the user's body, such as the shoulder, the upper back, the neck, the head, or a combination thereof. The control device can also display a video to illustrate proper body movements that can help to alleviate pain or strengthen related muscles. The App can also activate one or more treatment devices, when available, such as a heating or cooling pad positioned at the head rest fitting (12') for a predetermined period of time based on the treatment schedule.

The computing process can further comprise the steps of:

receiving user feedback data from the input/output device, wherein the user feedback data comprise evaluation, assessment, comments, or a combination thereof, of the signal schedule;

transmitting the user feedback data to the schedule database, a feedback database functionally coupled to the schedule database, or a combination thereof, wherein signal schedules are updated based on the user feedback data; and retrieving an updated signal schedule when receiving a subsequent user input signal.

The schedule database or the feedback database, or a functional copy thereof, can reside on the control device, a remote database server, or a combination thereof. In one example, an index sub-database of the schedule database in residing in the control device while the full schedule database and feedback database are residing in a remote database server, wherein the control device, the index sub-database, the full schedule database and the feedback database are functionally coupled enabling signals and data interchange. The control device or the remote database server can comprise an artificial intelligence (AI) module to collect and analyze the signal schedules and user feedback data from multiple users to produce the updated signal schedules for improved functionality. The AI module can comprise AI codes encoding an artificial intelligence (AI) process, including a self-learning process, to collect, process and analyze existing signal schedules and user feedback data and to produce updated signal schedules, wherein the AI codes are stored in a non-transitory computer usable storage medium. A neuron-network self-learning and other processes can be suitable. In one example the AI module is residing in a remote database server and producing updated signal schedules based on the user feedback data, wherein the control device can retrieve updated signal schedule in real time.

This invention is further directed to an App for a digital device comprising computer program stored in a non-transitory computer usable storage medium of the digital device. The computer program encodes a computing process comprising the steps of:

receiving sensing signals from one or more sensors coupled to the digital device;

generating subject data based on the sensing signals;

optionally, receiving a user input signal from an input/output device coupled to the digital device;

retrieving a signal schedule from a schedule database functionally coupled to the digital device based on the sensing signals, the subject data and optionally the user input signal; wherein the signal schedule comprises movement data on defined movements of movable parts of a mobility module coupled to the digital device and predefined time points;

generating control signals based on the sensing signals, the subject data and the signal schedule; and delivering the control signals to the mobility module to cause the defined movements of one or more of the movable parts at the predefined time points.

The computing process can further comprise the steps of:

receiving user feedback data from the input/output device, wherein the user feedback data comprise evaluation, assessment, comments, or a combination thereof, of the signal schedule;

transmitting the user feedback data to the schedule database, a feedback database functionally coupled to the schedule database, or a combination thereof, wherein signal schedules are updated based on the user feedback data with an artificial intelligence (AI) process; and retrieving an updated signal schedule when receiving a subsequent user input signal for retrieving the signal schedule.

Aforementioned AI process can be suitable. The App can be used in the aforementioned chair system. The App can be installed on the aforementioned control device. This process can provide self-learning to improve the signal schedule and provide the updated signal schedule.

The App can be configured to stream video on the display device or audio via a speaker coupled to the display device or one of the device couplers (24) for communicating or demonstrating how to do exercise or certain body movements. The video or audio can be provided by a professional therapist or trainer in real time or pre-recorded.

The video or audio provided by the professional therapist, the trainer, or modified through the Artificial intelligence (AI) can be recorded and saved in the schedule database and can be retrieved by the user. An automatic speech recognition (ASR) technology can be integrated into the App for voice based user input and retrieval.

User specific data, such as user's physical or medical exam data such as x-ray/MMR/Ultrasonic data, body improvement data, exercise or treatment log, vital sign data, user name, age, user ID, or a combination thereof, can be uploaded, entered or imported from other devices into the App, and can be saved and stored in a user database functionally coupled to the App or the control device. The data can be analyzed by the artificial intelligence process, a professional therapist or a trainer for further planning, improvement or optimizing treatment. The user specific data can be stored in a user account on the user database as determined suitable and managed by those skilled in the art according to pertinent technologies, regulations or requirements.

One advantage of the chair system and the App disclosed herein is to provide a person with multiple seating postures, such as seating with back up-right, lying down on the back while facing up, or lying down while facing down.

Another advantage of the chair system is that the chair system can provide predefined movements of a certain parts, such as the seat back, the seat bottom, the arm rest, the foot rest, or a combination thereof, resulting in movements of parts of the person's body at a predefined time points that may help to relax and to reduce muscle stress or spine fatigue.

Yet another advantage of the chair system is that the control module can be configured to cause defined movements of one or more of the movable parts at a set of predefined time points helping the person seated on the chair to avoid prolonged exposure to a certain posture reducing the possibility of over burdening some parts of the person's body.

The chair system can be used as a working station for a person doing computing, designing, drawing or reading for extended periods of time.

The chair system can also be used in hospital, hospice, senior care home, nursing home, or any other facilities for taking care of persons in a short period of time, such as from a day to a few weeks, or an extended period of time, such as from a few months to many years.

What is claimed is:

1. A chair system comprising:

a seating module configured to support a person, said seating module comprises a polarity of movable parts;

a seat support module coupled to the seating module;

a mobility module functionally coupled to the seating module configured to independently cause defined movements of each of the movable parts based on control signals; and a control module functionally coupled to the mobility module to provide the control signals;

wherein the control module is configured to provide the control signals to the mobility module to cause defined movements of one or more of the movable parts at a set of predefined time points when the chair system is in operation;

wherein the seating module comprises a seat back, a head rest, a seat bottom, a foot rest and a pair of arm rests functionally coupled together forming a chair, wherein the movable parts are selected from the seat back, a part of the seat back, the head rest, a part of the head rest, the seat bottom, a part of the seat bottom, the foot rest, a part of the foot rest, the arm rests, a part of the arm rests, the seat support module, a part of the seat support module, or a combination thereof; and wherein said foot rest has one side affixed to a foot rest coupling that is affixed to the seat support module or the seat bottom, wherein the foot rest coupling has a rotational axis F-F' that is parallel to perspective surface planes of the foot rest and the seat bottom so that the foot rest is configured to rotate along said rotational axis F-F'.

2. The chair system of claim 1, wherein the control module is selected from a wired control device, a wireless control device, or a combination thereof.

3. The chair system of claim 2, wherein the wireless control device comprises a motion sensor, and wherein the wireless control device is configured to provide one or more of the control signals by predefined motions of the wireless device.

4. The chair system of claim 1 further comprising a working module coupled to the seating module, the seat support module, or a combination thereof, wherein the working module comprises an accessory frame and a working accessory functionally coupled together.

5. The chair system of claim 4, wherein the control module is further configured to provide a warning signal based on a predefined schedule and wherein the working module further comprises a warning device functionally coupled to the control module to provide a predefined warning based on a warning signal.

6. The chair system of claim 4, to wherein the working accessory comprises a working surface, a device holder, and an optional illumination device.

7. The chair system of claim 1, wherein the mobility module further comprises an energy storage device.

8. The chair system of claim 7 further comprising a solar energy device functionally coupled to the energy storage device.

9. The chair system of claim 1 further comprising a discharge processing module functionally coupled to the seating module, the seat support module, or a combination thereof, to receive and store discharged materials.

10. The chair system of claim 1 further comprising a plurality of sensors functionally coupled to the seating module, the supporting module and the control module.

11. The chair system of claim 1 further comprising at least a treatment device for treating a body condition of a person, wherein the treatment device is selected from an electronic treatment device, a light treatment device, an electron-magnetic treatment device, a thermal treatment device, a mechanical treatment device, or a combination thereof.

* * * * *